US008007636B2

(12) United States Patent
Greschik et al.

(10) Patent No.: US 8,007,636 B2
(45) Date of Patent: Aug. 30, 2011

(54) METHOD OF TREATING CELLULOSE FIBRES WITH CHLORINE DIOXIDE AND AN ALKYL CELLULOSE DERIVATIVE

(75) Inventors: Thomas Christopher Greschik, Gothenborg (SE); Jan Nordin, Kvissleby (SE); Hans-Ake Baltsen, Varberg (SE)

(73) Assignee: Akzo Nobel N.V., Arnhem (NL)

( * ) Notice: Subject to any disclaimer, the term of this patent is extended or adjusted under 35 U.S.C. 154(b) by 152 days.

(21) Appl. No.: 11/238,148

(22) Filed: Sep. 29, 2005

(65) Prior Publication Data

US 2006/0096722 A1 May 11, 2006

Related U.S. Application Data

(60) Provisional application No. 60/625,131, filed on Nov. 5, 2004.

(51) Int. Cl.
*D21C 9/14* (2006.01)

(52) U.S. Cl. ..... 162/87; 8/557; 8/559; 162/67

(58) Field of Classification Search ..... 8/557; 162/87
See application file for complete search history.

(56) References Cited

U.S. PATENT DOCUMENTS

| | | | | |
|---|---|---|---|---|
| 3,878,037 | A * | 4/1975 | Hansen et al. | 162/73 |
| 7,285,184 | B2 * | 10/2007 | Li et al. | 162/163 |
| 7,303,654 | B2 * | 12/2007 | Tokarz et al. | 162/181.8 |
| 2002/0098317 | A1 | 7/2002 | Jaschinski et al. | |
| 2004/0000012 | A1 | 1/2004 | Scarpello et al. | |
| 2004/0140074 | A1 * | 7/2004 | Tokarz et al. | 162/181.8 |
| 2005/0161177 | A1 * | 7/2005 | Gustavsson et al. | 162/9 |

FOREIGN PATENT DOCUMENTS

| | | | |
|---|---|---|---|
| EP | 0444335 | B1 | 12/1994 |
| JP | 9-291490 | A | 11/1997 |
| JP | 2002-513872 | A | 5/2002 |
| JP | 2002-180391 | A | 6/2002 |
| JP | 2004-137653 | A | 5/2004 |
| JP | 2004-043992 | A | 12/2004 |
| WO | WO 9418298 | A1 * | 8/1994 |
| WO | WO 99/57370 | | 11/1999 |
| WO | WO 99/57370 | A1 | 11/1999 |
| WO | WO 01/21890 | A1 | 3/2001 |
| WO | WO 03/080924 | A1 | 10/2003 |

OTHER PUBLICATIONS

Smook, Handbook for Pulp and Paper Technologists, 1992, Angus Wilde Publications, 2nd edition, pp. 220-225.*
Hubbe et al. Preventing Strength Loss of Unbleached Kraft Pulp, May 16, 2003, NC State University.*
Gullichsen et al., Chemical Pulping 6A,1999, Fapet Oy, A636,A641-A643.*
Machine English Translation of JP 2002-180391A, Sep. 25, 2010.*
Gullichsen et al., Chemical Pulping 6A, 1999, Fapet Oy, pp. A635-A665.*
Smook, Handbook for Pulp and Paper Technologists, 1992, Angus Wilde Publications, 2nd edition, chapters 11 and 16.*
International Search Report completed Dec. 9, 2005, 4 pages.
Written Opinion of the International Searching Authority, 5 pages.
Patent Abstracts of Japan abstracting JP 2002-180391.
Patent Abstracts of Japan abstracting JP 2004-043992.
Patent Abstracts of Japan abstracting JP 2004-137653.
Patent Abstracts of Japan abstracting JP 9-291490.
Japanese Office Action for Japanese Patent Application No. 2007-540278, dated Dec. 22, 2009.
English language translation of Japanese Office Action for Japanese Patent Application No. 2007-540278, dated Dec. 22, 2009.

* cited by examiner

*Primary Examiner* — Matthew J Daniels
*Assistant Examiner* — Anthony J Calandra
(74) *Attorney, Agent, or Firm* — Robert C. Morriss; David J. Serbin

(57) ABSTRACT

The present invention relates to methods of modifying cellulose fibers and of producing paper which methods include providing a pulp suspension of cellulose fibers and adding a cellulose derivative during the bleaching of the cellulose fibers in an acidic bleaching stage.

13 Claims, 1 Drawing Sheet

METHOD OF TREATING CELLULOSE FIBRES WITH CHLORINE DIOXIDE AND AN ALKYL CELLULOSE DERIVATIVE

This application claims priority from U.S. Provisional Application No. 60/625,131, filed on Nov. 5, 2005, the subject matter of which is incorporated herein by reference.

The present invention relates to a method of treating cellulose fibres. The invention further involves the production of paper from said treated fibres and the paper obtainable therefrom. The invention also relates to the use of a cellulose derivative as an additive to an acidic bleaching stage.

BACKGROUND OF THE INVENTION

In the field of papermaking, various methods of improving the wet strength of paper are known by retaining wet strength agents to the cellulosic fibres in the pulp suspension while forming the paper. The wet strength of a paper relates to its ability to maintain physical integrity and to resist tearing, bursting, and shredding under use, especially under wet conditions. A further important property of wet strengthened paper is the softness, especially for tissue paper or the like. The softness can be described as the tactile sensation perceived when holding or rubbing a paper across the skin.

WO01/21890 discloses a method of modifying cellulose fibres to provide high wet strength to a paper. This method, however, involves adding electrolyte to the pulp suspension and treating it at a temperature of at least 100° C. which restricts flexibility and the use of this process.

The present invention intends to provide an energy-efficient and simple method for producing paper with increased wet strength and softness as well as other advantageous properties imparted by the modification of the fibres. It is a further object of the present invention to provide a method which can be used with conventional existing equipment and machinery.

THE INVENTION

Figure 1:
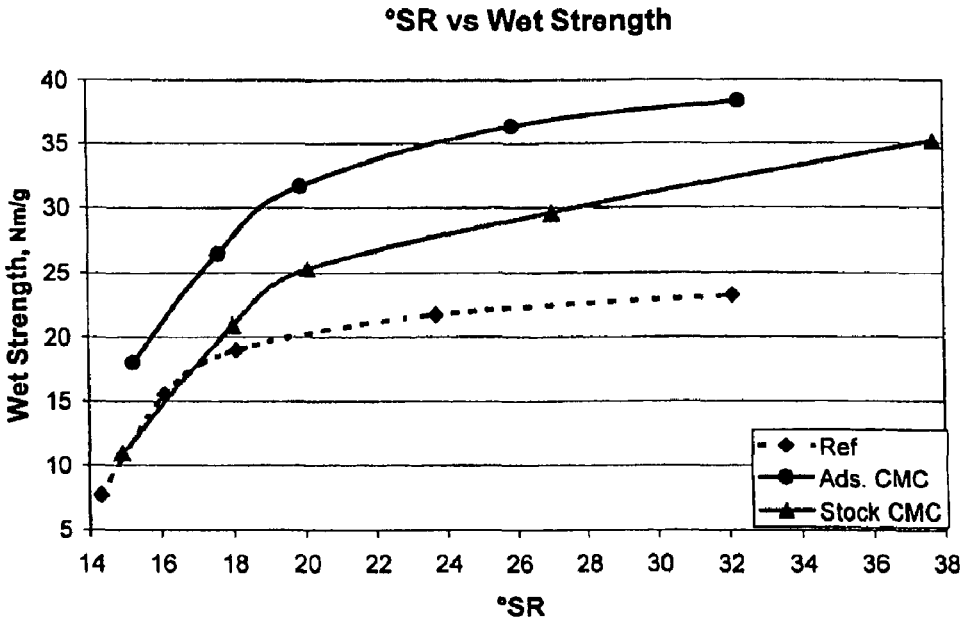
FIG. 1 is a graph showing the effect on wet strength as a function of beating degree (°SR) for CMC containing pulps and pulp without CMC according to the examples.

The present invention relates to a method of modifying cellulose fibres comprising providing a pulp suspension of cellulose fibres, adding a cellulose derivative during the bleaching of said cellulose fibres to at least one acidic bleaching stage.

Preferably, no electrolyte is added in conjunction with the addition of cellulose derivative, except for optional addition of acid or base to adjust the pH. Addition of a pH regulating base or acid may be made in an amount of about 0.001 to about 0.5 M if the electrolyte is univalent. Addition of e.g. $Ca^{2+}$ or other bivalent electrolyte could in some cases increase the risk of precipitation of calcium oxalate. Equipment used in the bleaching process may then become clogged with such precipitates derived from electrolytes since the pulps may naturally contain e.g. oxalic acid. The electrolyte, however, does not significantly influence the modification of the fibres.

The pH of the pulp suspension in the acidic bleaching stage suitably is from about 1 to about 7, more preferably from about 2 to about 6, and most preferably from about 2 to about 4.

The temperature during the acidic bleaching suitably is from about 30 to about 95, preferably from about 60 to about 90° C.

Preferably, the dry content of cellulose fibres in the pulp suspension is from about 1 to about 50, more preferably from about 15 to about 30, and most preferably from about 5 to about 15 wt %.

The bleaching suitably is performed for about 0.1 to about 10, preferably from about 1 to about 5, and most preferably from about 1 to about 3 hours. The acidic bleaching stage at which the cellulose derivative is added may be during any of the stages where the pulp is treated with chlorine dioxide, ozone, peracid, or other acidic bleaching treatment stages, preferably during the treatment with chlorine dioxide. In this context, also acidic stages integrated in the bleaching process or sequences of acidic bleaching stages such as washing steps, acidification, or acidic chelating stages are here also meant to be included in the bleaching treatment during which a cellulose derivative may be added.

It has been found that the adsorption of cellulose derivatives to cellulose fibres, particularly the adsorption of CMC to fibres results in significantly increased surface charge compared to non-CMC treated wood fibres.

This may be the explanation why the wet strength of a paper produced from the CMC-treated pulp in which CMC was added to an acidic bleaching stage was significantly increased as well as the relative wet strength when a wet strength agent subsequently was added to the paper furnish in a papermaking process.

The present method can thus also impart enhanced softness properties of the produced paper. The softness of a paper sheet can be estimated, at least indirectly, by means of the relative wet strength value, which is defined as the ratio between the wet tensile index and the dry tensile index according to the formula RWS (in %)=(WS/DS)·100, where RWS stands for the relative wet strength, WS is the wet tensile index and DS is the dry tensile index of a paper. RWS is often a good measure of the softness of a paper; the higher the RWS, the higher the softness of the paper.

The modification with a cellulose derivative may also influence the effect of any subsequent addition of paper chemicals to the pulp furnish which in turn may influence both the necessary dosage of the paper chemicals to the pulp furnish as well as the quality of the obtained paper product.

It has also been seen that sizing, retention and dewatering can be improved as a result of the modified cellulosic fibres in papermaking processes.

Any further paper chemicals suitable in the production of paper may be added to the pulp furnish containing the modified bleached cellulose fibres. Such chemicals may include e.g. dry strength, wet strength agents, retention agents, sizing agents etc.

The cellulose fibres may be derived from any type of soft or hard wood-based or nonwood-based material, e.g. pre-bleached, half-bleached or unbleached sulphite, sulphate or soda pulps or unbleached, half-bleached or pre-bleached mechanical, thermomechanical, chemo-mechanical and chemo-thermomechanical pulps, and mixtures thereof. As examples of nonwood materials can be mentioned e.g. bagasse, kenaf, grass fibres, sisal or the like.

The cellulose derivative, preferably an alkyl cellulose derivative, and most preferably a carboxymethyl cellulose derivative, is water-soluble or at least partly water-soluble or water-dispersible, preferably water-soluble or at least partly water-soluble. Preferably, the cellulose derivative is ionic. The cellulose derivative can be anionic, cationic or amphoteric, preferably anionic or amphoteric. Examples of suitable cellulose derivatives include cellulose ethers, e.g. anionic and amphoteric cellulose ethers, alkali cellulose, cellulose metal complexes, graft copolymer cellulose preferably anionic cellulose ethers. The cellulose derivative preferably has ionic or charged groups, or substituents. Examples of suitable ionic groups include anionic and cationic groups. Examples of suitable anionic groups include carboxylate, e.g. carboxyalkyl, sulphonate, e.g. sulphoalkyl, phosphate and phosphonate groups in which the alkyl group can be methyl, ethyl propyl and mixtures thereof, suitably methyl; suitably the cellulose derivative contains an anionic group comprising a carboxylate group, e.g. a carboxyalkyl group. The counterion of the anionic group is usually an alkali metal or alkaline earth metal, suitably sodium.

Examples of suitable cationic groups of cellulose derivatives according to the invention include salts of amines, suitably salts of tertiary amines, and quaternary ammonium groups, preferably quaternary ammonium groups. The substituents attached to the nitrogen atom of amines and quaternary ammonium groups can be same or different and can be selected from alkyl, cycloalkyl, and alkoxyalkyl groups, and one, two or more of the substituents together with the nitrogen atom can form a heterocyclic ring. The substituents independently of each other usually comprise from 1 to about 24, preferably from 1 to about 8 carbon atoms. The nitrogen of the cationic group can be attached to the cellulose or derivative thereof by means of a chain of atoms which suitably comprises carbon and hydrogen atoms, and optionally O and/or N atoms. Usually the chain of atoms is an alkylene group with from 2 to 18 and preferably 2 to 8 carbon atoms, optionally interrupted or substituted by one or more heteroatoms, e.g. O or N such as alkyleneoxy group or hydroxy propylene group. Preferred cellulose derivatives containing cationic groups include those obtained by reacting cellulose or derivative thereof with a quaternization agent selected from 2,3-epoxypropyl trimethyl ammonium chloride, 3-chloro-2-hydroxypropyl trimethyl ammonium chloride and mixtures thereof.

The cellulose derivatives of this invention can contain non-ionic groups such as alkyl or hydroxy alkyl groups, e.g. hydroxymethyl, hydroxyethyl, hydroxypropyl, hydroxylbutyl and mixtures thereof, e.g. hydroxyethyl methyl, hydroxypropyl methyl, hydroxybutyl methyl, hydroxyethyl ethyl, hydroxypropyl and the like. In a preferred embodiment of the invention, the cellulose derivative contains both ionic groups and non-ionic groups.

Examples of suitable cellulose derivatives according to the invention include carboxyalkyl celluloses, e.g. carboxymethyl cellulose, carboxyethyl cellulose, carboxy-propyl cellulose, sulphoethyl carboxymethyl cellulose, carboxymethyl hydroxyethyl cellulose ("CM-HEC"), carboxymethyl cellulose wherein the cellulose is substituted with one or more non-ionic substituents, preferably carboxymethyl cellulose ("CMC"). Examples of suitable cellulose derivatives and methods for their preparation include those disclosed in U.S. Pat. No. 4,940,785, which is hereby incorporated herein by reference.

The terms "degree of substitution" or "DS", as used herein, mean the number of substituted ring sites of the beta-anhydroglucose rings of the cellulose derivative. Since there are three hydroxyl groups on each anhydroglucose ring of the cellulose that are available for substitution, the maximum value of DS is 3.0. According to one preferred embodiment of the invention, the cellulose derivative has a degree of substitution of net ionic groups ("$DS_{NI}$") up to about 0.65, i.e. the cellulose derivative has an average degree of net ionic substitution per glucose unit up to about 0.65. The net ionic substitution can be net anionic, net cationic or net neutral. When the net ionic substitution is net anionic, there is a net excess of anionic groups (net anionic groups=the average number of anionic groups minus the average number of cationic groups, if any, per glucose unit) and $DS_{NI}$ is the same as the degree of substitution of net anionic groups ("$DS_{NA}$"). When the net ionic substitution is net cationic, there is a net excess of cationic groups (net cationic groups=the average number of cationic groups minus the average number of anionic groups, if any, per glucose unit) and $DS_{NI}$ is the same as the degree of substitution of net cationic groups ("$DS_{NC}$"). When the net ionic substitution is net neutral, the average number of anionic and cationic groups, if any, per glucose unit is the same, and $DS_{NI}$ as well as $DS_{NA}$ and $DS_{NC}$ are 0. According to another preferred embodiment of the invention, the cellulose derivative has a degree of substitution of carboxyalkyl groups ("$DS_{CA}$") up to about 0.65, i.e. the cellulose derivative has an average degree of carboxyalkyl substitution per glucose unit up to about 0.65. The carboxyalkyl groups are suitably carboxymethyl groups and then $DS_{CA}$ referred to herein is the same as the degree of substitution of carboxymethyl groups ("$DS_{CM}$"). According to these embodiments of the invention, $DS_{NI}$, $DS_{NA}$, $DS_{NC}$ and $DS_{CA}$ independently of each other are usually up to about 0.60, suitably up to about 0.50, preferably up to about 0.45 and more preferably up to 0.40, whereas $DS_{NI}$, $DS_{NA}$, $DS_{NC}$ and $DS_{CA}$ independently of each other are usually at least 0.01, suitably at least about 0.05, preferably at least about 0.10 and more preferably at least about 0.15. The ranges of $DS_{NI}$, $DS_{NA}$, $DS_{NC}$ and $DS_{CA}$ independently of each other are usually from about 0.01 to about 0.60, suitably from about 0.05 to about 0.50, preferably from about 0.10 to about 0.45 and more preferably from about 0.15 to about 0.40.

Cellulose derivatives that are anionic or amphoteric usually have a degree of anionic substitution ("$DS_A$") in the range of from 0.01 to about 1.0 as long as $DS_{NI}$ and $DS_{NA}$ are as defined herein; suitably from about 0.05, preferably from about 0.10, and more preferably from about 0.15 and suitably up to about 0.75, preferably up to about 0.5, and more preferably up to about 0.4. Cellulose derivatives that are cationic or amphoteric can have a degree of cationic substitution ("$DS_C$") in the range of from 0.01 to about 1.0 as long as $DS_{NI}$ and $DS_{NC}$ are as defined herein; suitably from about 0.02, preferably from about 0.03, and more preferably from about 0.05 and suitably up to about 0.75, preferably up to about 0.5, and more preferably up to about 0.4. The cationic groups are suitably quaternary ammonium groups and then $DS_C$ referred to herein is the same as the degree of substitution of quaternary ammonium groups ("$DS_{QN}$"). For amphoteric cellulose derivatives of this invention $DS_A$ or $DS_C$ can of course be higher than 0.65 as long as $DS_{NA}$ and $DS_{NC}$, respectively, are as defined herein. For example, if $DS_A$ is 0.75 and $DS_C$ is 0.15, then $DS_{NA}$ is 0.60.

The water-soluble cellulose derivatives suitably have a solubility of at least 85% by weight, based on total weight of dry cellulose derivative, in an aqueous solution, preferably at least 90% by weight, more preferably at least 95% by weight, and most preferably at least 98% by weight.

The cellulose derivative usually has an average molecular weight which is at least 20000 Dalton, preferably at least 50000 Dalton, and up to about 1000000 Dalton, preferably up to about 50000 Dalton.

The cellulose derivative is suitably added in an amount of from about 0.5 to about 50, preferably from about 5 to about 20, and most preferably from about 5 to about 10 kg/t dry cellulose fibres.

The invention also relates to a paper obtainable by a method comprising dewatering on a wire a pulp furnish of modified bleached cellulose fibres produced according to a method as described herein and forming a paper of said dewatered pulp furnish.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. The following examples will further illustrate how the described invention may be performed without limiting the scope of it. If not otherwise stated, all parts and percentages refer to parts and percent by weight.

EXAMPLES

The aim of the experiment was to adsorb CMC to fibres in a final acidic bleaching stage which here was a chlorine dioxide stage. Even though not necessary, calcium chloride was used to enhance the adsorption. The used pulp was a five stage Elemental Chlorine Free bleached softwood pulp of full brightness having a final brightness of 90% ISO. A reference pulp was treated as the CMC modified pulp according to the invention but without the charge of CMC. The final chlorine dioxide stage was performed at 80.degree. C. for 180 minutes at a 10 wt % pulp consistency. The chemical charges were: 10 kg/t chlorine dioxide, as active chlorine 7 kg/t, 18 kg/t calcium chloride calculated as Ca.sup.2+ based on the weight of dry pulp. The end pH of the chlorine dioxide stage was 2.8. The used CMC was Finnfix WRH from Noviant. The degree of substitution was 0.5 and the molecular weight 110.sup.6. Wet strength agent Kenores XO was added at a charge of 15 kg/t dry pulp to the bleached pulp suspension. The strength properties of the CMC treated pulp were evaluated at different beating degrees (.degree. SR). The beating was performed in a lab-scale PFI beater. The strength properties of beaten CMC-treated pulp were compared with the non-CMC treated beaten reference pulp and with a pulp to which CMC was added to the pulp suspension subsequent to the bleaching. The analyzed pulp had a final brightness of 90% ISO that had been bleached with a final chlorine dioxide stage (in laboratory scale). The strenghth property results are shown in FIGS. 1 and 2.

As can be seen from FIG. 1, the wet strength is strongly increased when CMC has been adsorbed in a final chlorine dioxide stage compared to addition of CMC to the stock or with no CMC addition. Here, the increase in wet strength of the produced paper was up to 65%.

Figure 2:
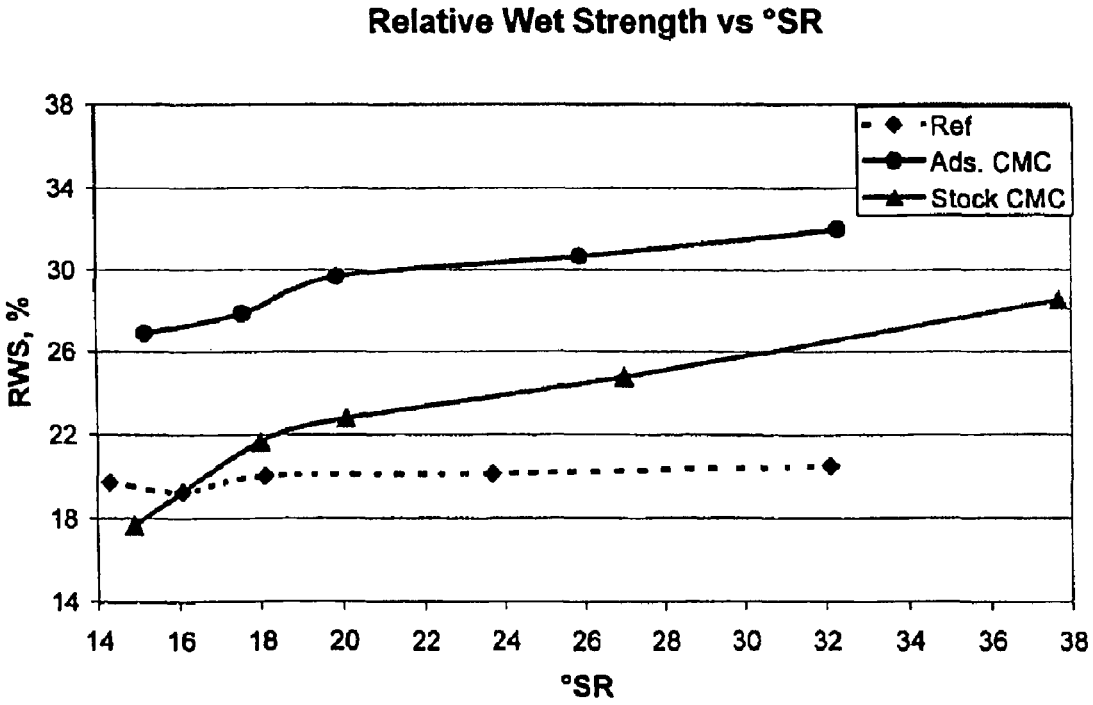
FIG. 2 is a graph showing the effect on relative wet strength (RWS) as a function of beating degree (°SR) for CMC containing pulps and pulp without CMC according to the examples.

In FIG. 2, RWS (relative wet strength) is plotted versus °SR for adsorbed CMC in the final acidic chlorine dioxide stage and addition of CMC to the stock in the papermaking process as well as a reference without addition of CMC. As is evident from FIG. 2, the RWS is considerably increased in a paper obtained by addition of CMC to the acidic chorine dioxide stage.

The invention claimed is:

1. A method of modifying cellulose fibers comprising providing a pulp suspension of cellulose fibers, subjecting said cellulose fibers to bleaching and adding an alkyl cellulose derivative in an amount from about 0.5 to about 20 kg/t of dry cellulose fibers during said bleaching of said cellulose fibers to at least one acidic chlorine dioxide bleaching stage.

2. A method according to claim 1, wherein the alkyl cellulose derivative is added to a final acidic chlorine dioxide bleaching stage.

3. A method according to claim 1, wherein the alkyl cellulose derivative is a carboxyalkyl cellulose.

4. A method according to claim 1, wherein the alkyl cellulose derivative is carboxymethyl cellulose.

5. A method according to claim 1, wherein the dry content of the cellulose fibers in the pulp suspension is from about 1 to about 50 wt %.

6. A method according to claim 1, wherein a wet strength agent is subsequently added.

7. A method according to claim 1, wherein a dry strength agent is subsequently added.

8. A method according to claim 1, wherein the bleaching stage is a final bleaching stage performed at a pH from about 2 to about 4.

9. A method of producing paper comprising dewatering on a wire a pulp furnish comprising modified cellulose fibers and wet strength agent and forming a paper of said dewatered pulp furnish which modified cellulose fibers have been obtained by providing a pulp suspension of cellulose fibers, subjecting said cellulose fibers to bleaching and adding an alkyl cellulose derivative in an amount from about 0.5 to about 20 kg/t dry cellulose fibers during said bleaching of said cellulose fibers to a final acidic chlorine dioxide stage, wherein the pH during said bleaching is 2 to 4.

10. A method according to claim 9, wherein the alkyl cellulose derivative is a carboxyalkyl cellulose.

11. A method according to claim 9, wherein the alkyl cellulose derivative is carboxymethyl cellulose.

12. A method according to claim 9, wherein a dry strength agent is subsequently added.

13. A method of producing paper comprising providing a pulp suspension of a bleached pulp obtained by providing a pulp suspension of cellulose fibers comprising providing a pulp suspension of cellulose fibers, subjecting said cellulose fibers to bleaching and adding an alkyl cellulose derivative in an amount from about 0.5 to about 20 kg/t dry cellulose fibers during said bleaching of said cellulose fibers to at least one acidic chlorine dioxide bleaching stage, dewatering said bleached pulp suspension on a wire and forming a paper of the dewatered pulp.

* * * * *